US006922886B2

(12) United States Patent
Costley, Jr.

(10) Patent No.: US 6,922,886 B2
(45) Date of Patent: Aug. 2, 2005

(54) APT-1 (ANODE PLACEMENT TOOL-MODEL 1)

(76) Inventor: John L. Costley, Jr., P.O. Box 565, Palmetto, FL (US) 34220-0565

( * ) Notice: Subject to any disclaimer, the term of this patent is extended or adjusted under 35 U.S.C. 154(b) by 564 days.

(21) Appl. No.: 10/191,350

(22) Filed: Jul. 6, 2002

(65) Prior Publication Data

US 2004/0003991 A1 Jan. 8, 2004

(51) Int. Cl.[7] ..... B23P 19/00

(52) U.S. Cl. ..... 29/746; 29/729; 29/757; 29/760; 405/211.1; 405/216; 405/157; 405/167; 204/196.17; 204/196.3; 204/196.37

(58) Field of Search ..... 29/729, 746, 757; 204/196.17, 196.22, 196.23, 196.24, 196.25, 196.3, 196.34, 196.35, 196.37; 405/211.1, 157, 167, 216; 205/730, 740

(56) References Cited

U.S. PATENT DOCUMENTS

| | | | | | |
|---|---|---|---|---|---|
| 3,994,795 | A | * | 11/1976 | Kurr | 204/196.16 |
| 4,176,033 | A | * | 11/1979 | Council | 204/196.15 |
| 4,215,458 | A | | 8/1980 | Lancaster | 29/213.1 |
| 4,284,488 | A | * | 8/1981 | Brittain et al. | 204/196.15 |
| 4,309,263 | A | * | 1/1982 | Boyd | 204/196.17 |
| 4,392,934 | A | | 7/1983 | Viellefont | 204/198 |
| 4,394,242 | A | | 7/1983 | Clark | 205/374 |
| 4,414,070 | A | | 11/1983 | Spence | 204/225 |
| 4,484,838 | A | | 11/1984 | Stevens | 405/191 |
| 4,484,839 | A | | 11/1984 | Nandial | 205/732 |
| 4,484,840 | A | * | 11/1984 | Nandlal et al. | 205/732 |
| 4,537,071 | A | | 8/1985 | Waterman | 73/866.5 |
| 4,657,284 | A | * | 4/1987 | Fiori | 285/39 |
| 4,678,147 | A | * | 7/1987 | Barnes et al. | 248/74.1 |
| 4,698,474 | A | * | 10/1987 | Gugel et al. | 219/60 A |
| 4,705,331 | A | * | 11/1987 | Britton | 439/387 |
| 4,877,354 | A | * | 10/1989 | Williamson | 405/157 |
| 4,934,673 | A | * | 6/1990 | Bahler | 269/43 |
| 5,738,769 | A | | 4/1998 | Chin | 204/285 |
| 5,743,675 | A | | 4/1998 | Fluharty | 405/180 |
| 5,827,013 | A | | 10/1998 | Fluharty | 405/180 |
| 6,090,264 | A | | 7/2000 | Piron | 205/389 |
| 6,193,443 | B1 | | 2/2001 | Tredeau | 405/252 |
| 6,220,641 | B1 | * | 4/2001 | Muniak | 294/104 |
| 6,279,617 | B1 | | 8/2001 | Havn | 138/155 |
| 6,461,082 | B1 | * | 10/2002 | Smith | 405/211.1 |
| 6,832,427 | B2 | * | 12/2004 | Meuth et al. | 29/446 |
| 6,846,023 | B2 | * | 1/2005 | Ebinger et al. | 285/420 |

* cited by examiner

*Primary Examiner*—Bruce F. Bell

(57) ABSTRACT

An apparatus designed for installing anode bracelets upon pipes used in cathodic protection systems. The apparatus includes a pair of grasp booms which hold the anode bracelet during installation of the bracelet around the pipe to be cathodically protected. The grasp booms can be rotated for the installation of the anode bracelet and can be opened to receive each half of the bracelet and closed to mount the bracelet around the pipe.

4 Claims, 25 Drawing Sheets

APT-1 (ANODE PLACEMENT TOOL-MODEL 1)

DESCRIPTION

The APT 1 (Anode Placement Tool—Model 1) is a device to enable the more rapid installation of "Anode Bracelets" as they are called in the common language of the pipeline working world. Anodes are a part of the requirement of the cathodic protection system to protect pipelines. Whether that pipeline is buried under the ground or offshore under the water a need exists for the pipe to have a number of Anodes to give that pipeline cathodic protection. At present the anode is handled a number of times but there is no tool to place "Anode Bracelets" on the pipe in a manner that has the speed of installation that The APT 1 (Anode Placement Tool—Model 1) will make possible.

The APT 1 (Anode Placement Tool—Model 1) is intended to make the manual portion of installing an Anode upon the pipe a thing of the past.

The anodes are shipped to the pipe yard on pallets where they are to be installed.

The lift boom on The APT 1 (Anode Placement Tool—Model 1) lifts one half (½) of the Anode Bracelet (there are two (2) parts to make the entire anode cover the circumference of the pipe) from the pallet. The lift boom then sets the one half (½) into the "palms" of The APT 1 (Anode Placement Tool—Model 1) when that one half (½) sets against the "palm", then the "grip tooth" secures that half of the anode on both sides of that anode half.

The lift boom then repeats the procedure again so that the entire anode for that section is ready to be placed upon the pipe. The APT 1 (Anode Placement Tool—Model 1) then rotates approximately ninety (90 ) degrees and the anode is where it may be placed upon the pipe. The grasp booms that hold the palms are held open enough so that the anode weld tabs do not touch the pipe. The Anode Bracelet is now ready to be placed in the proper position. The booms close until there is contact with the pipe and if either portion of the Anode Bracelet needs a rotational adjustment then the hydraulic cylinders that are under or over that grasp boom may be moved because the palms have a slide groove to enable that portion of the work to be done hydraulically. The palms also have a hinge that is attached to a hydraulic cylinder that enables the palms to squeeze the anode half so that anode half may better conform to the roundness aspect of the pipe upon where the Anode Bracelet is to be placed. The welder may then proceed to weld those weld tabs (incorporated into each anode half) on that Anode Bracelet. This will allow the pipe to move on to the next step of the process.

Disclaimer: There were no Federal Funds used to develop this Patent

THE DRAWING FIGURES

Figure 1:
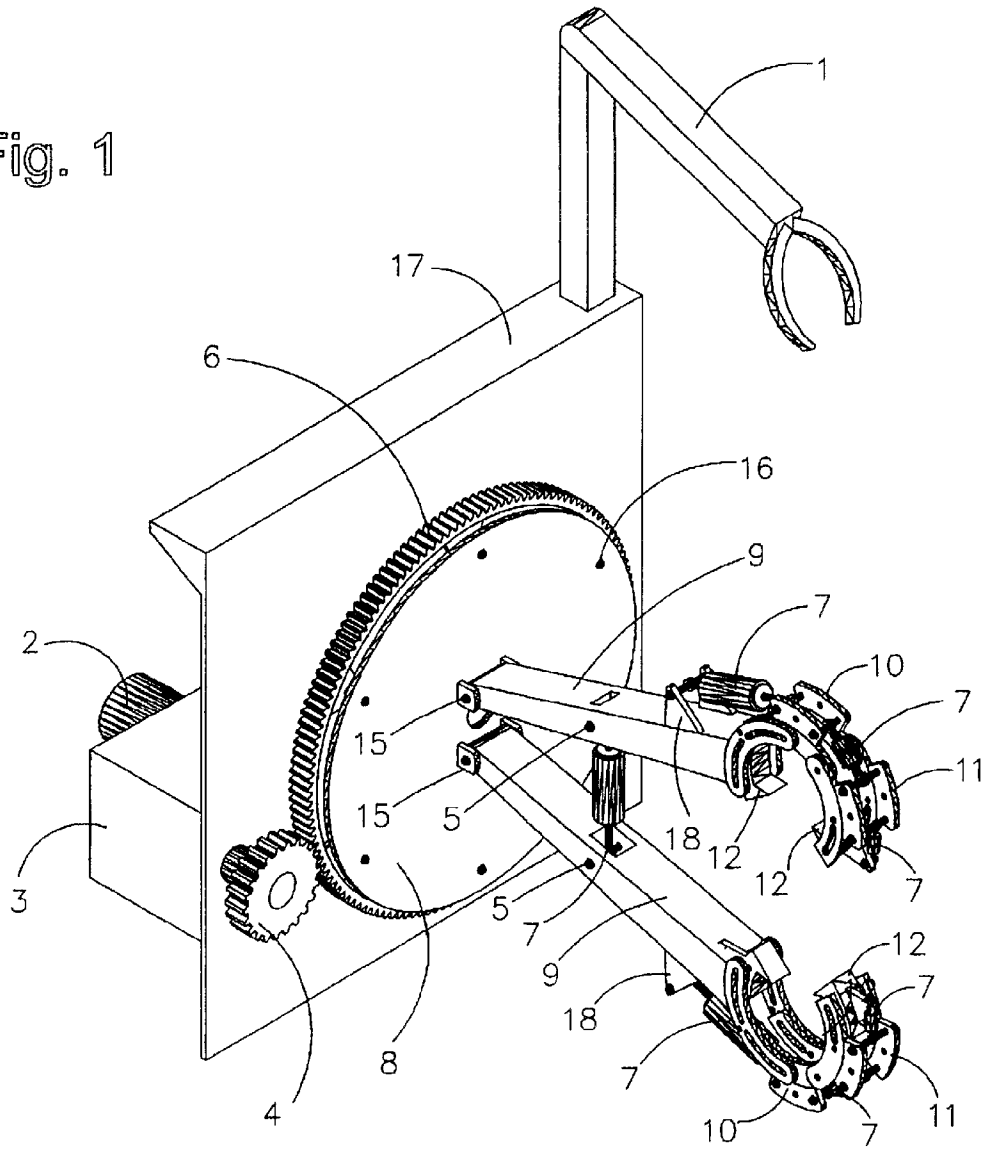
FIG. 1 is an Isometric view of the APT 1 (Anode Placement Tool—Model 1)
Figure 2:
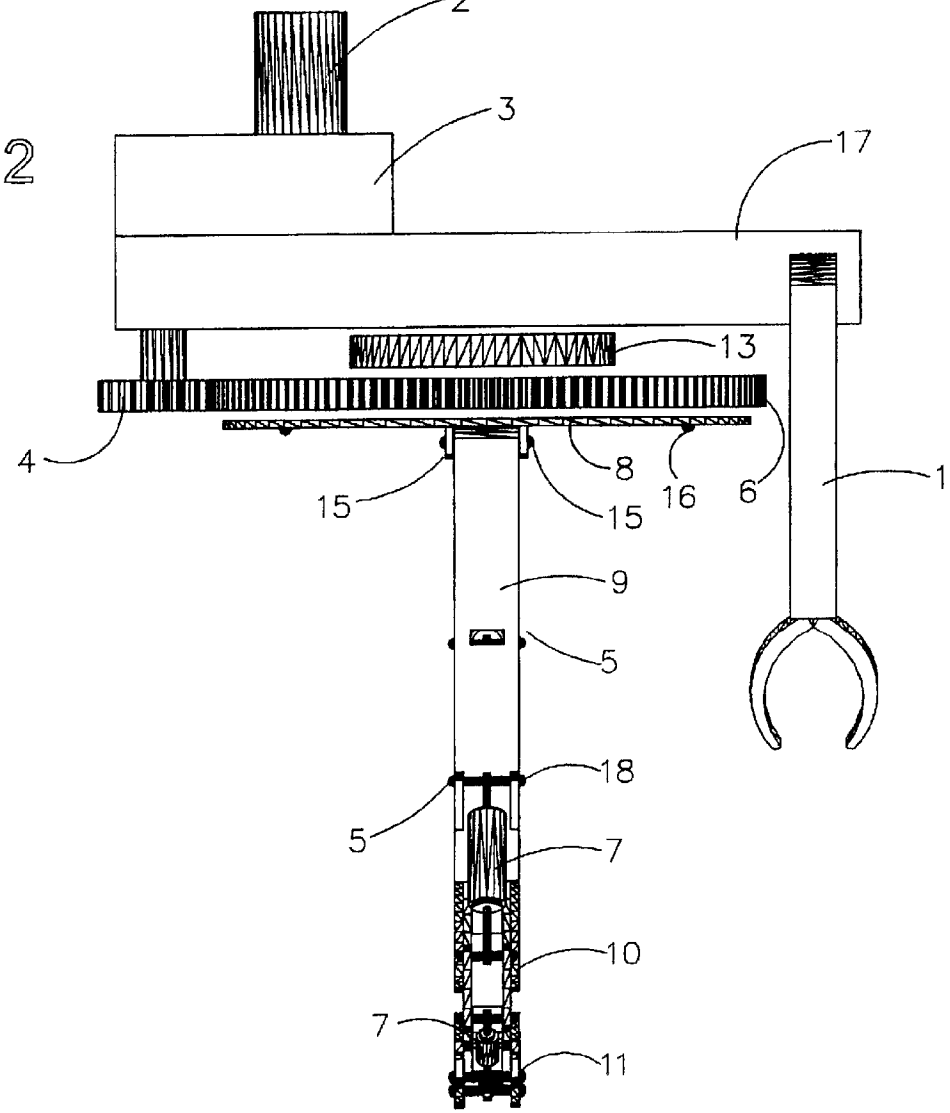
FIG. 2 is a plan view of the APT 1 (Anode Placement Tool—Model 1). That portion behind the 8) mounting plate is exploded to make that portion of the design clearer.
Figure 3:
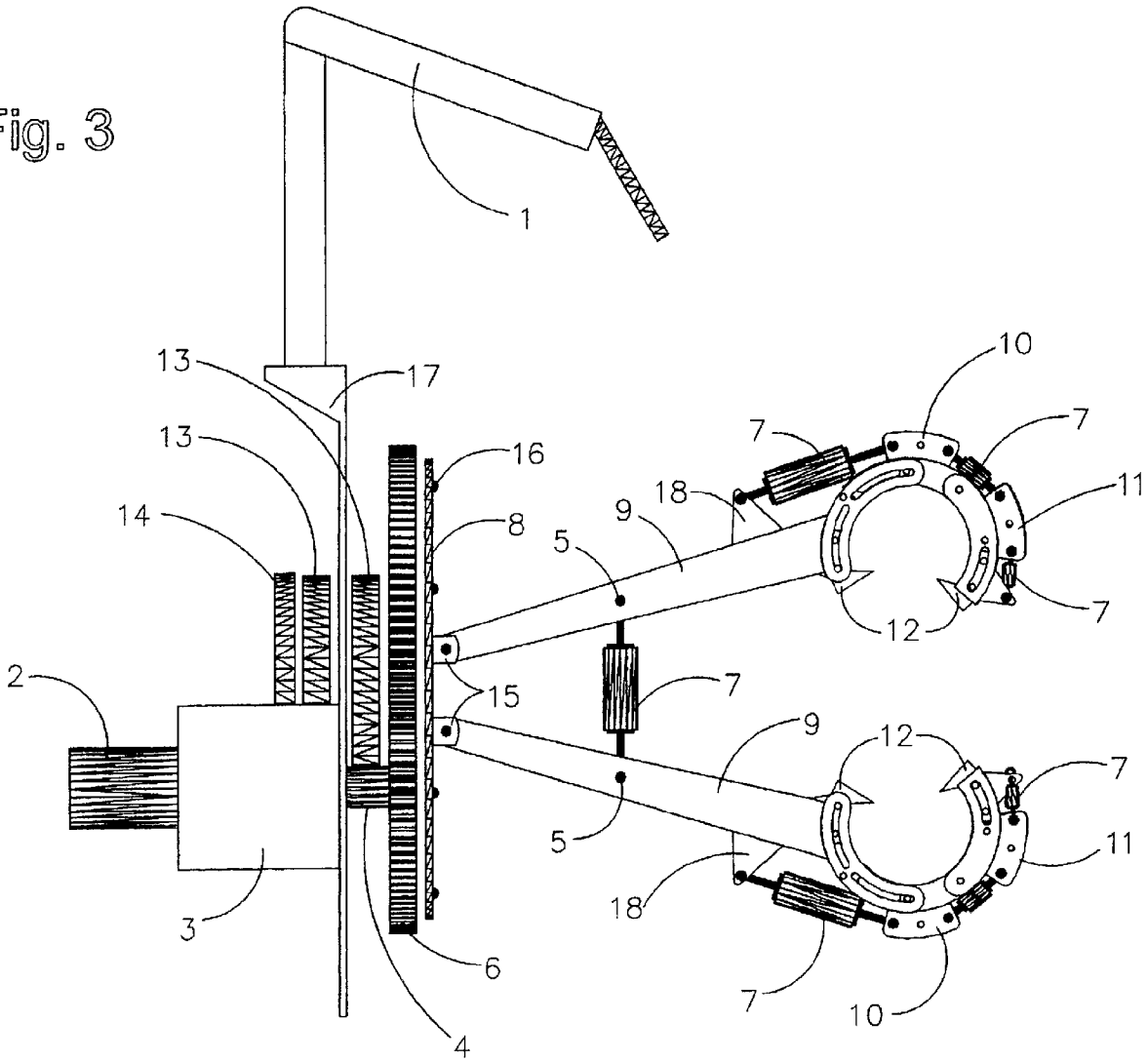
FIG. 3 is a side view of the APT 1 (Anode Placement Tool—Model 1). That portion behind the 8) mounting plate is exploded to make that portion of the design clearer.
Figure 4:
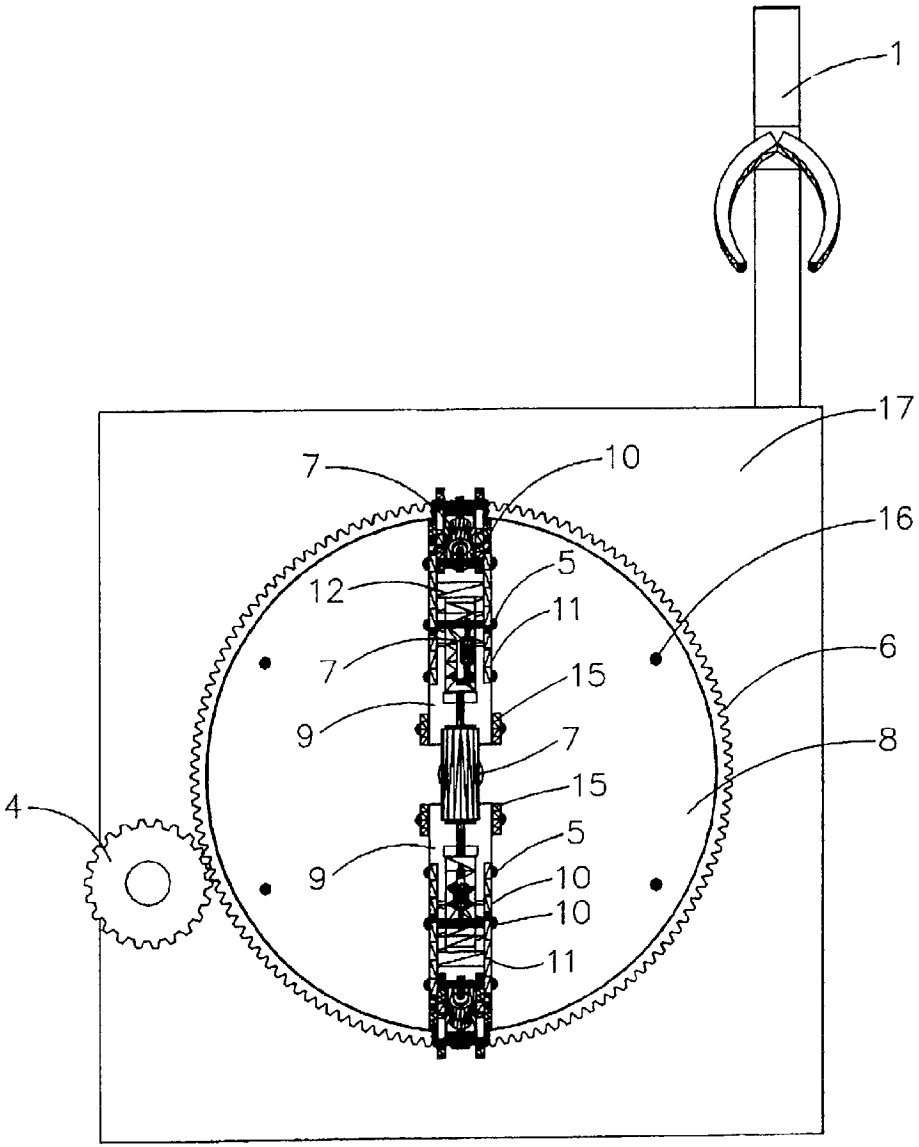
FIG. 4 is a front view of the APT 1 (Anode Placement Tool—Model 1) where the grasp boom is in a vertical rotation view
Figure 5:
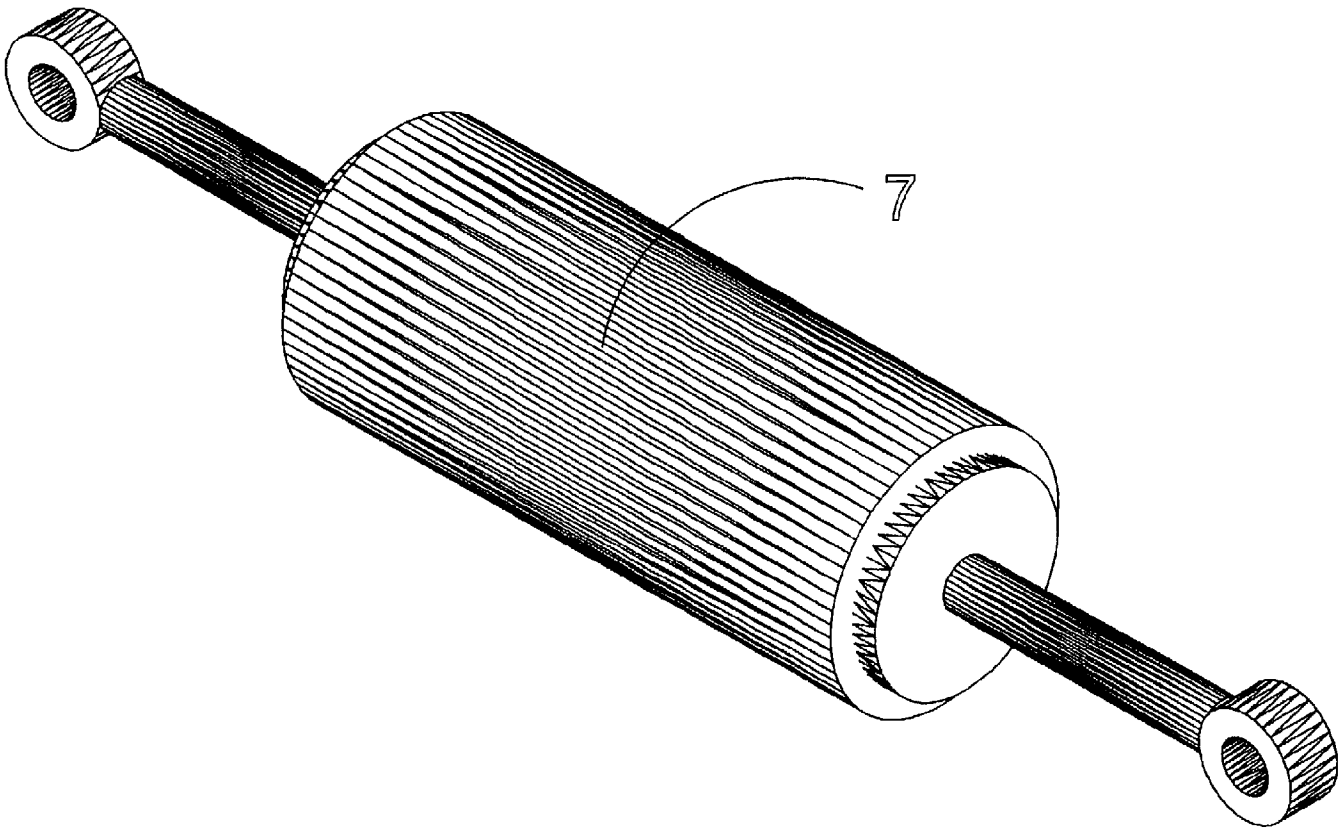
FIG. 5 is an isometric view of a hydraulic cylinder employed in of the APT 1 (Anode Placement Tool—Model 1)
Figure 6:
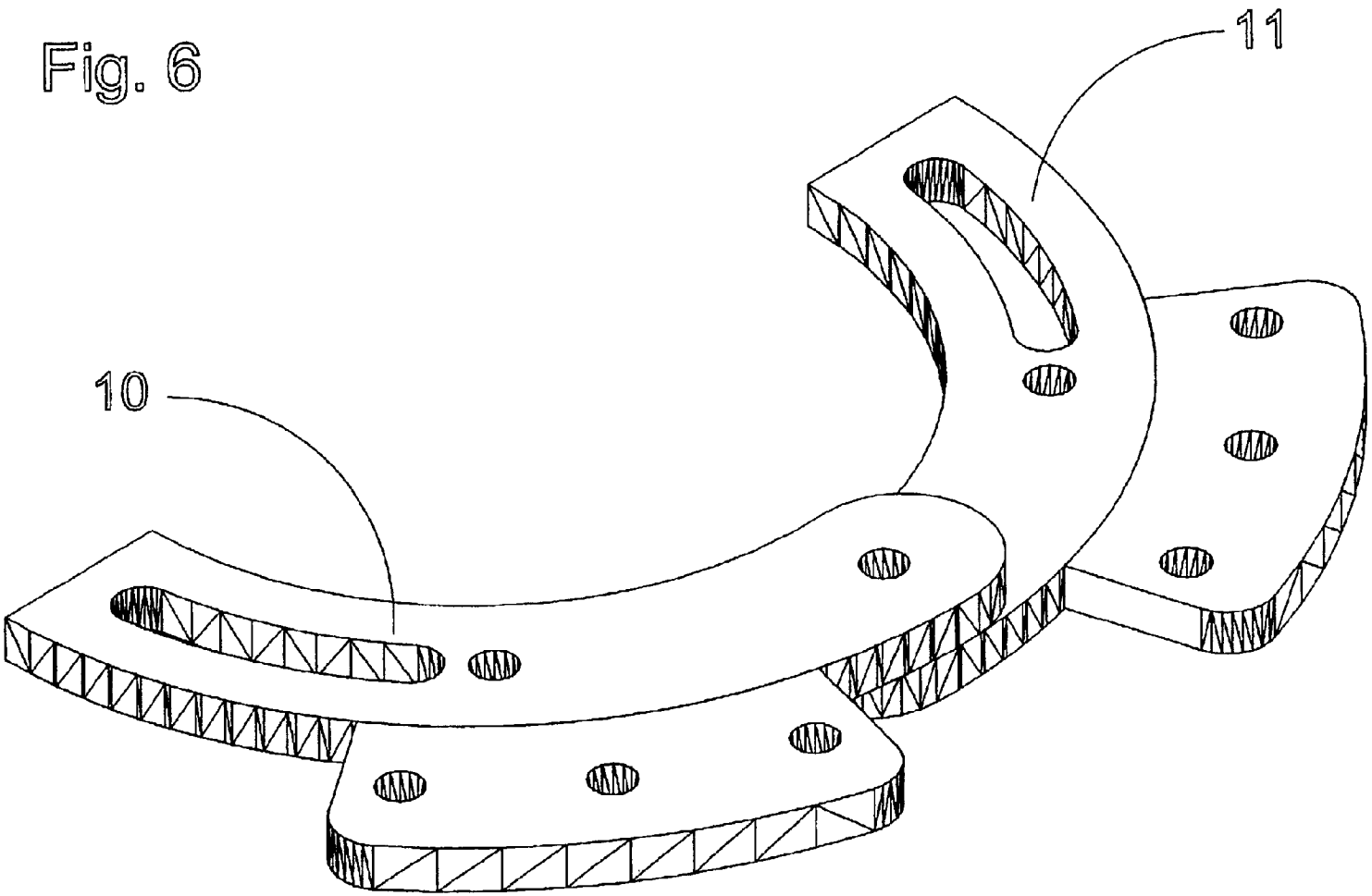
Figure 7:
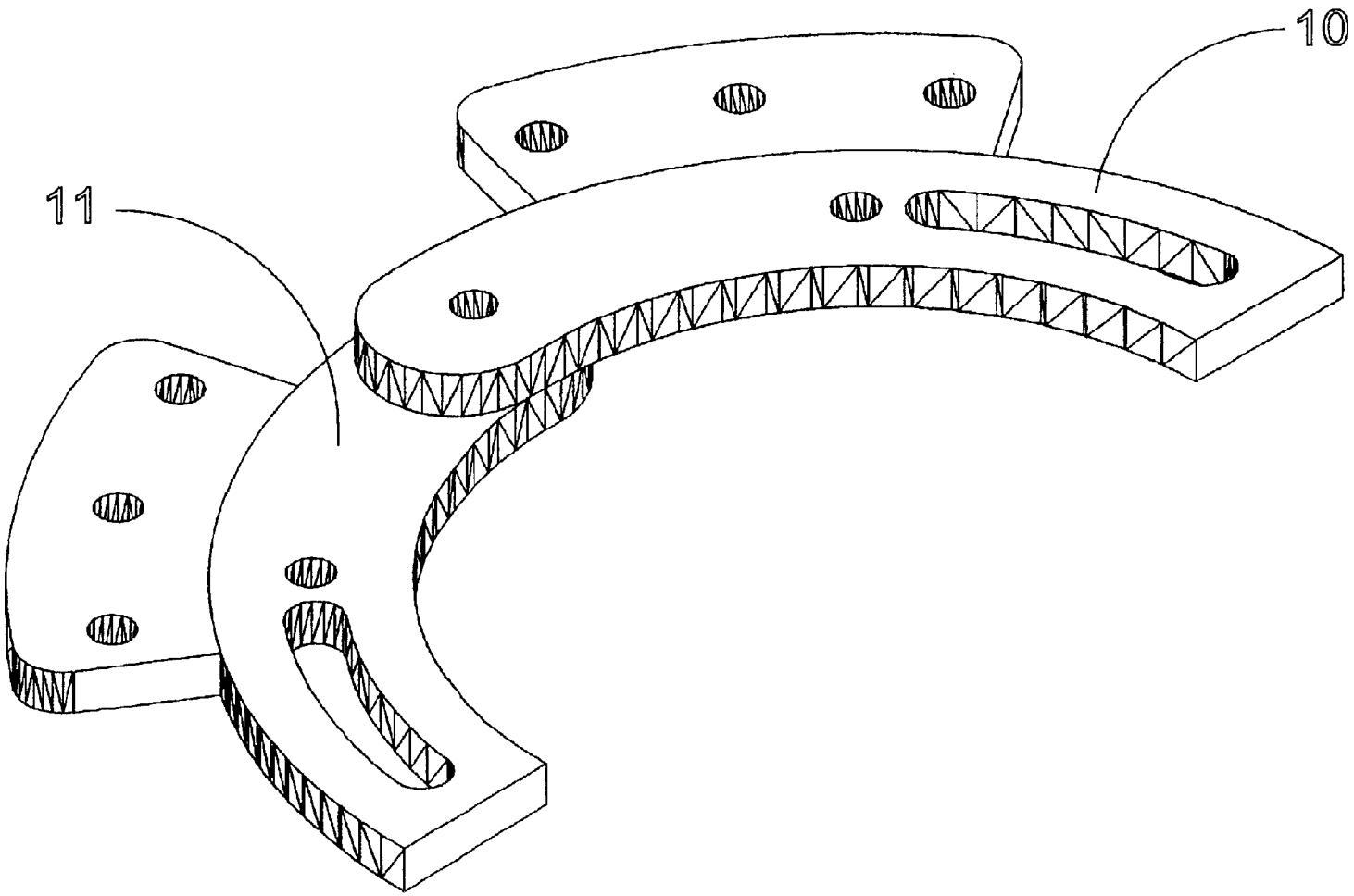
Figure 8:
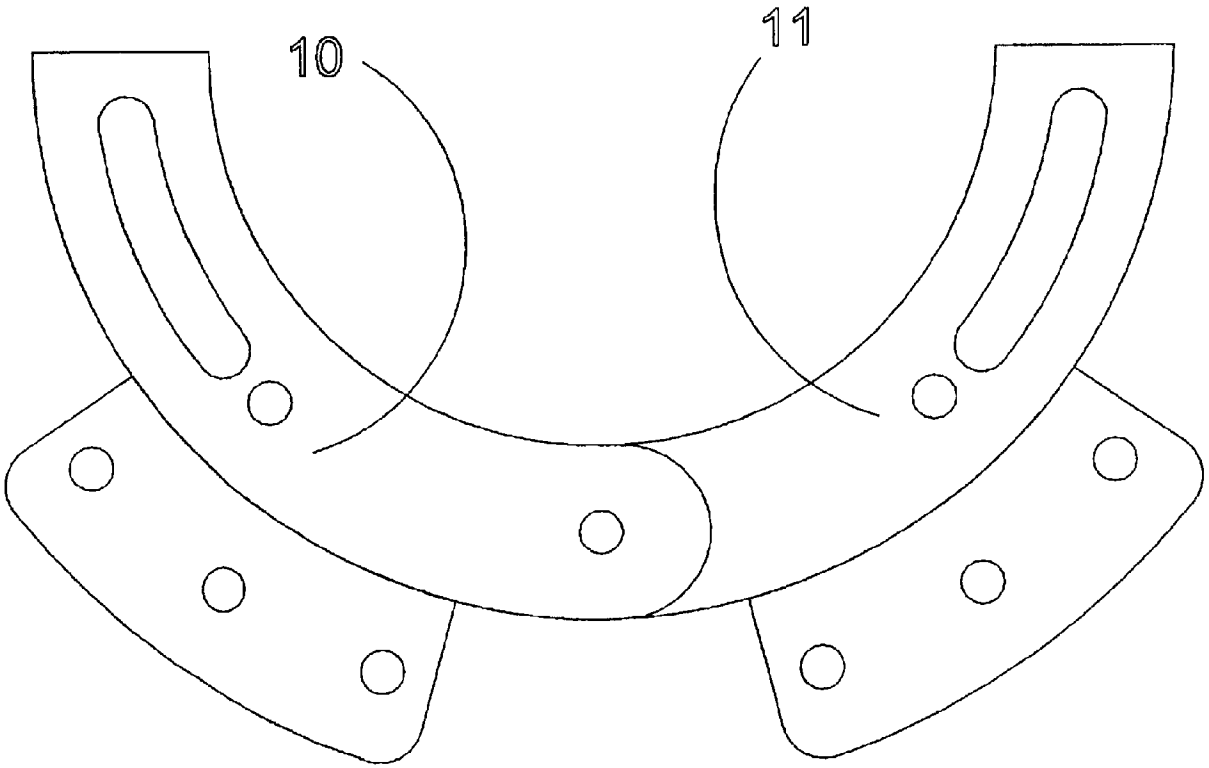
Figure 9:
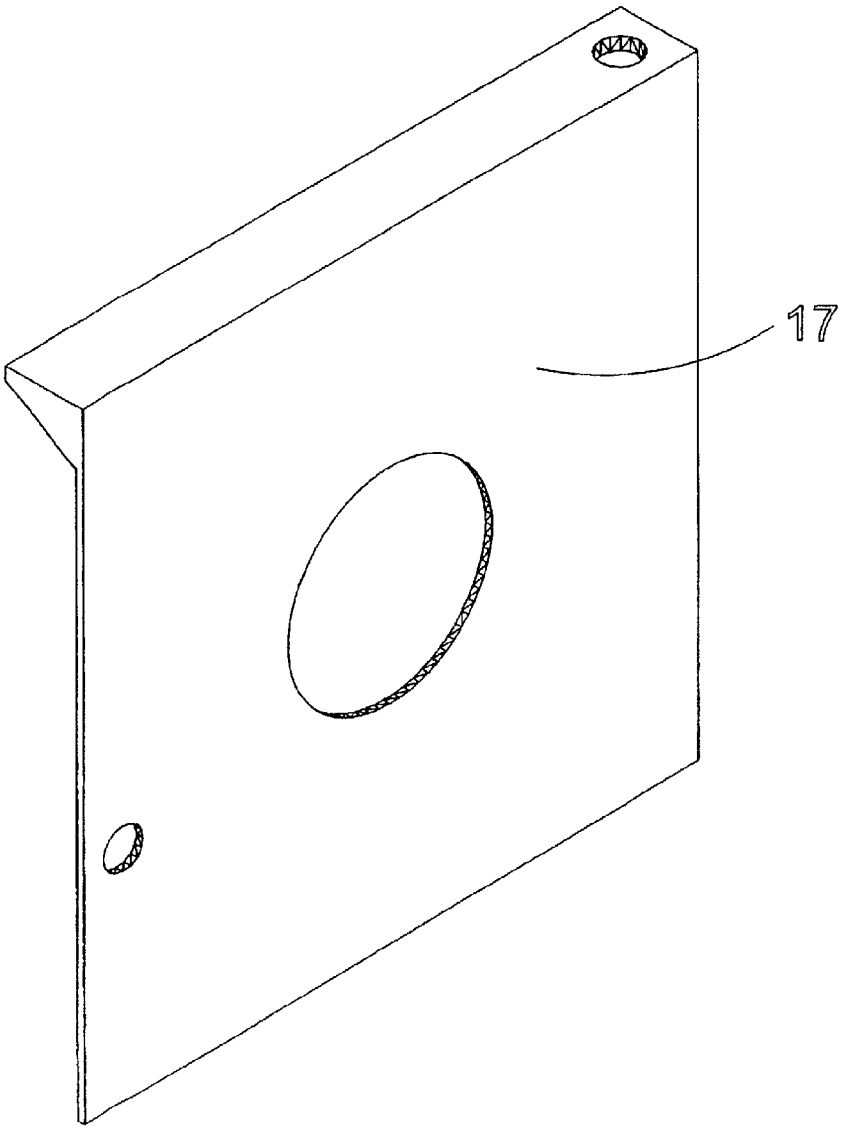
Figure 10:
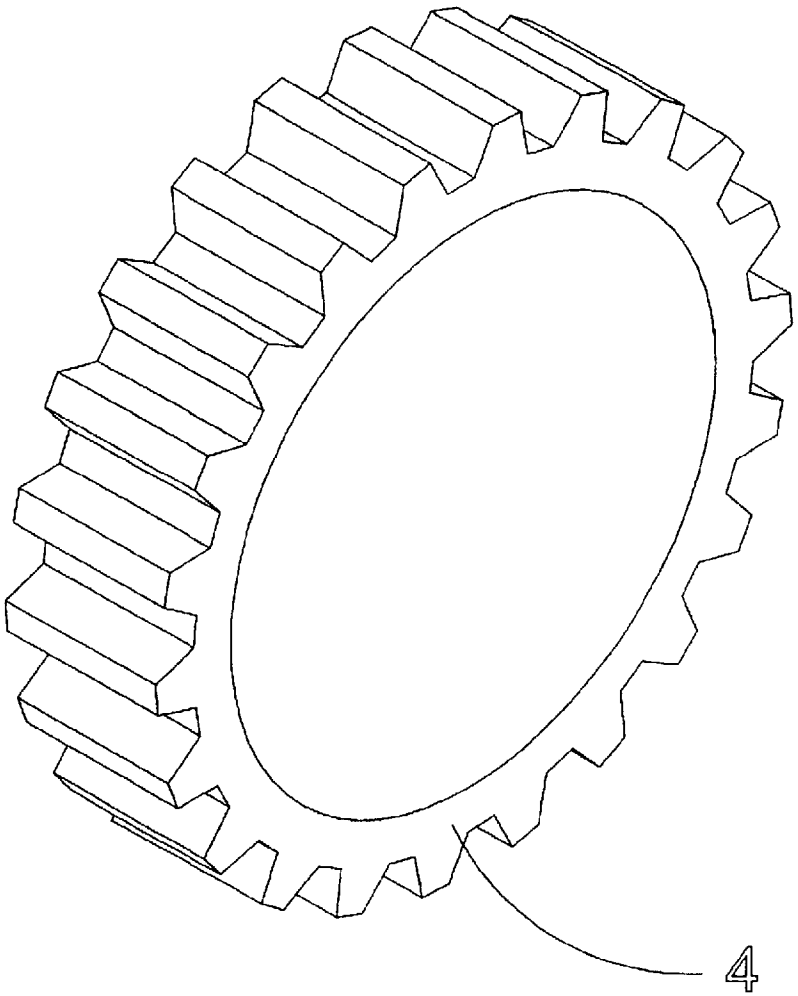
Figure 11:
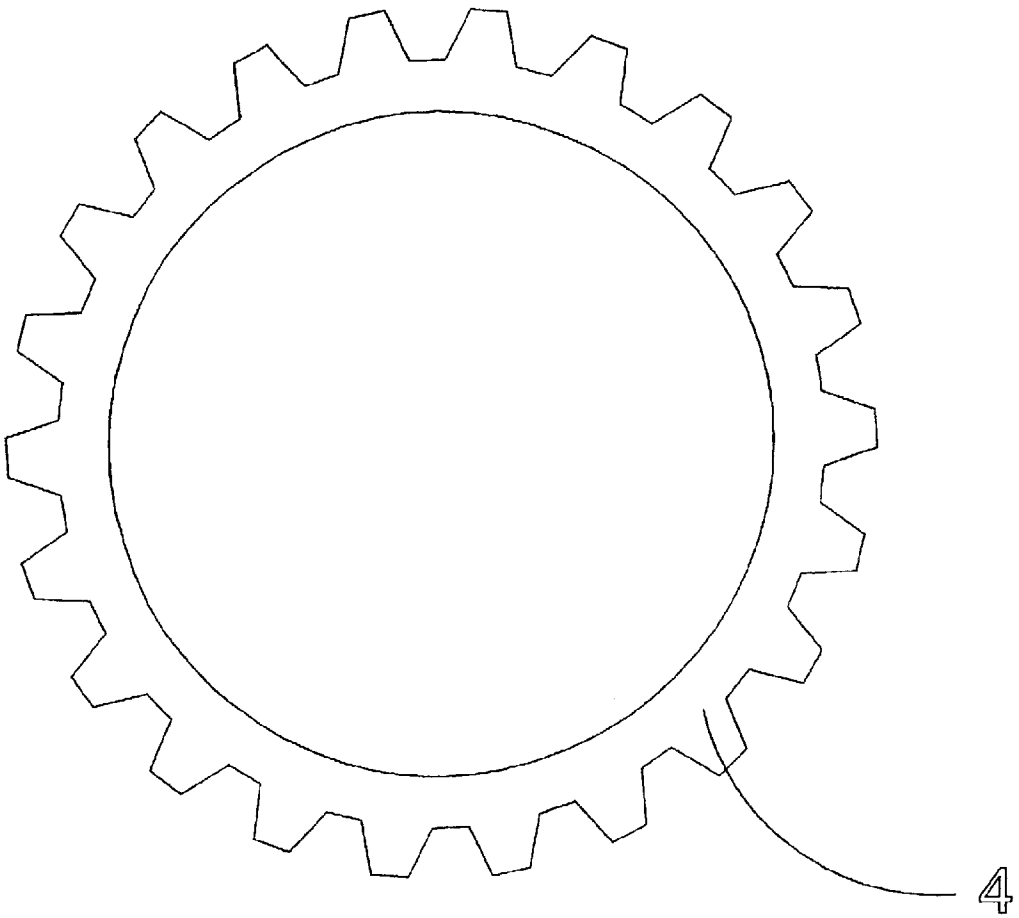
Figure 12:
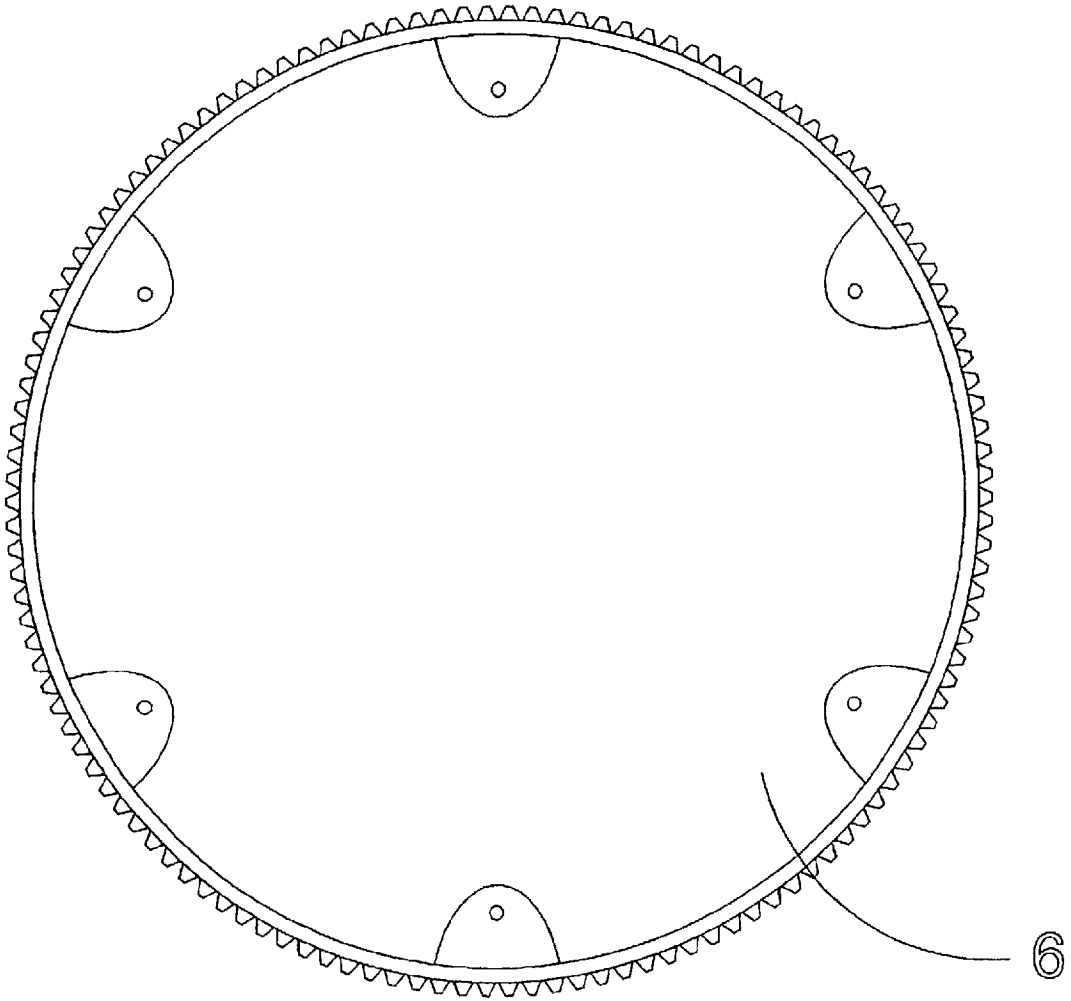
Figure 13:
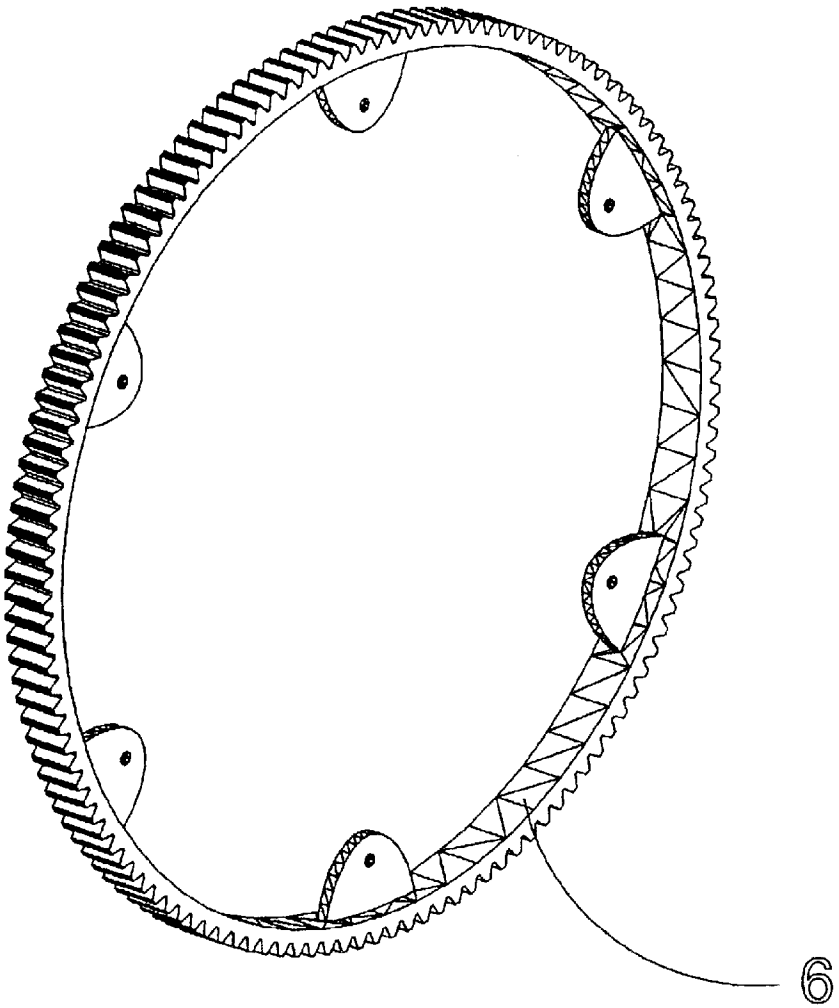
Figure 14:
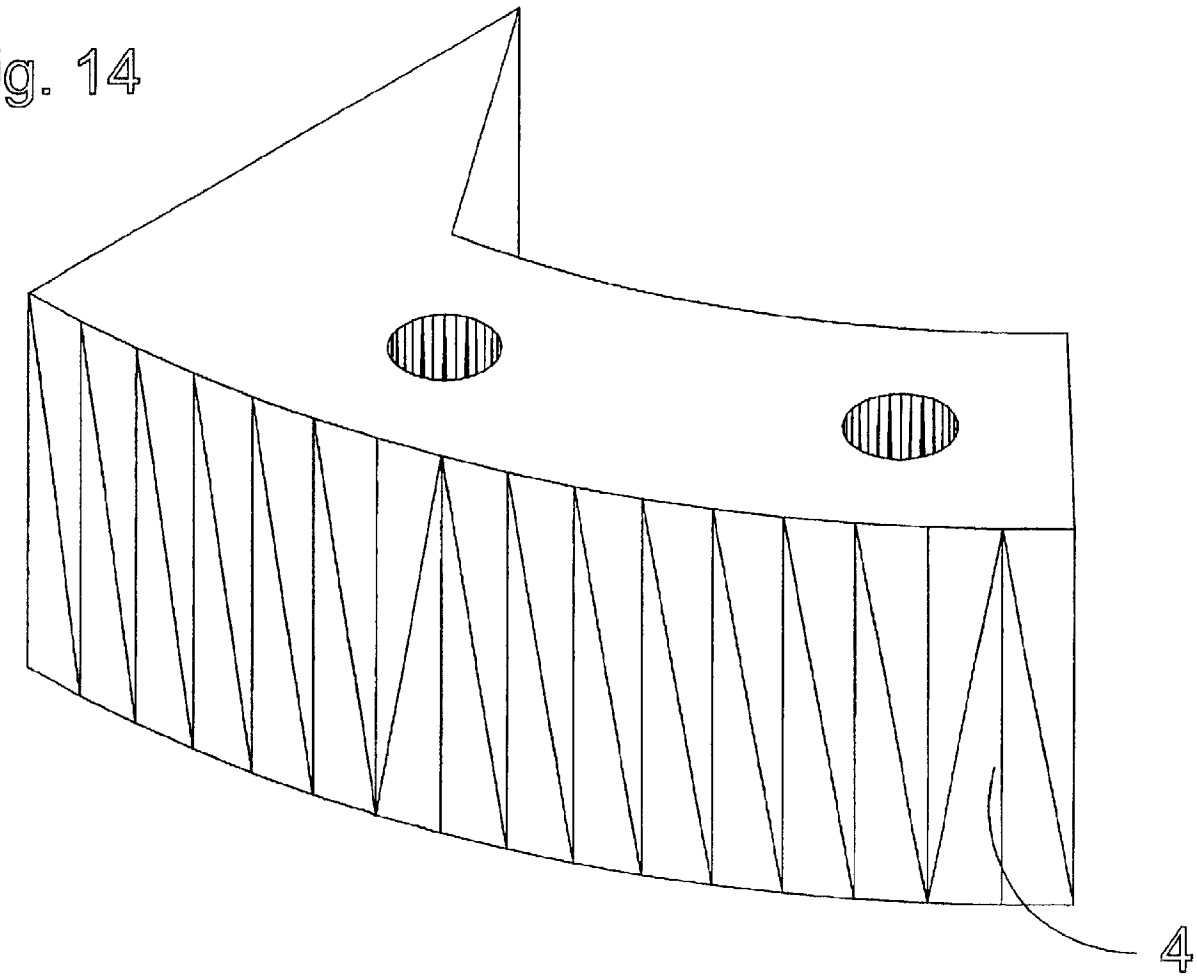
Figure 15:
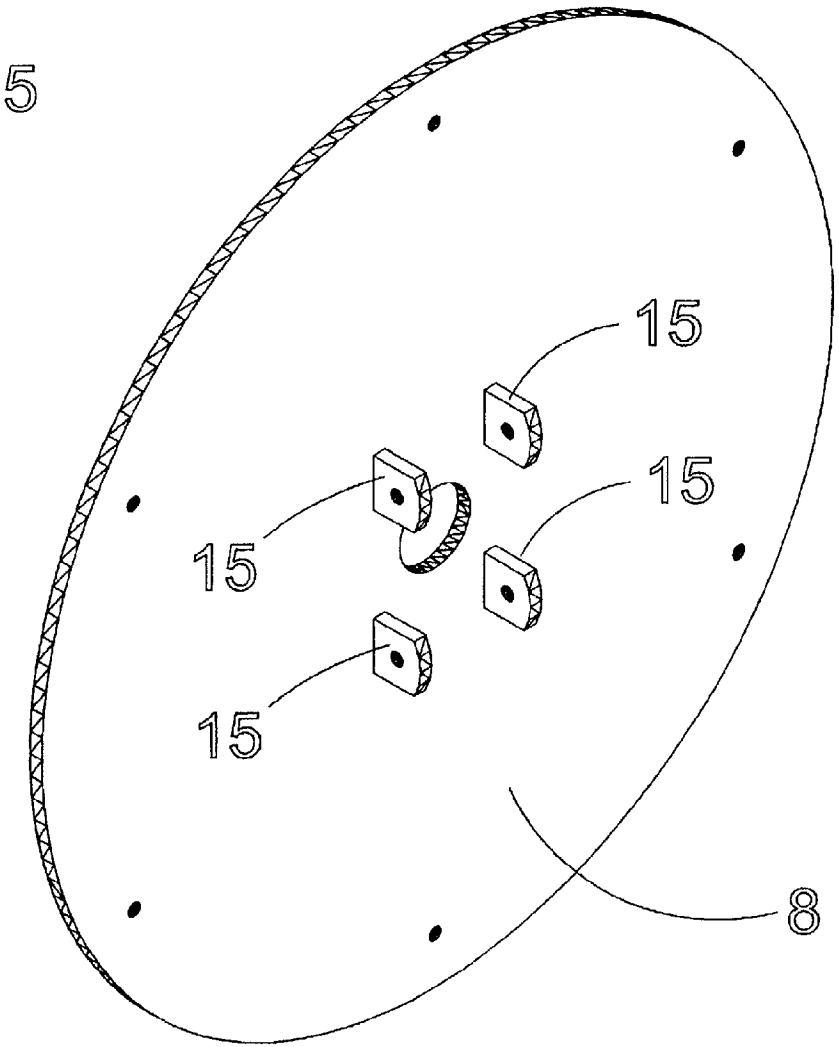
Figure 16:
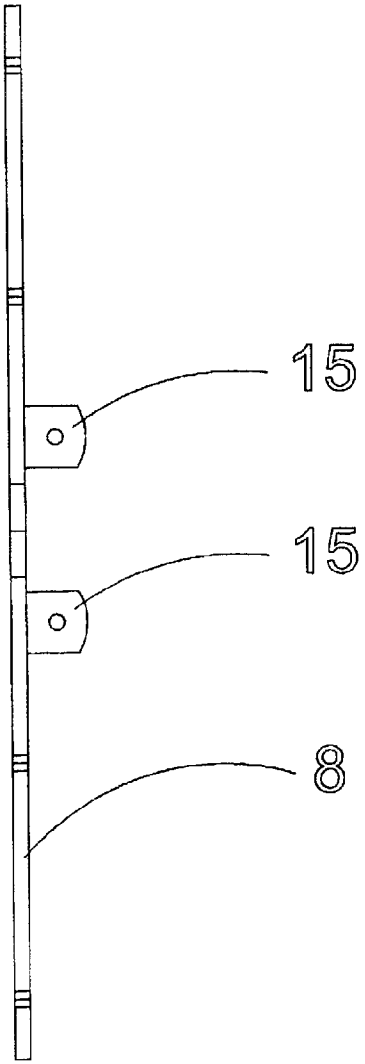
Figure 17:
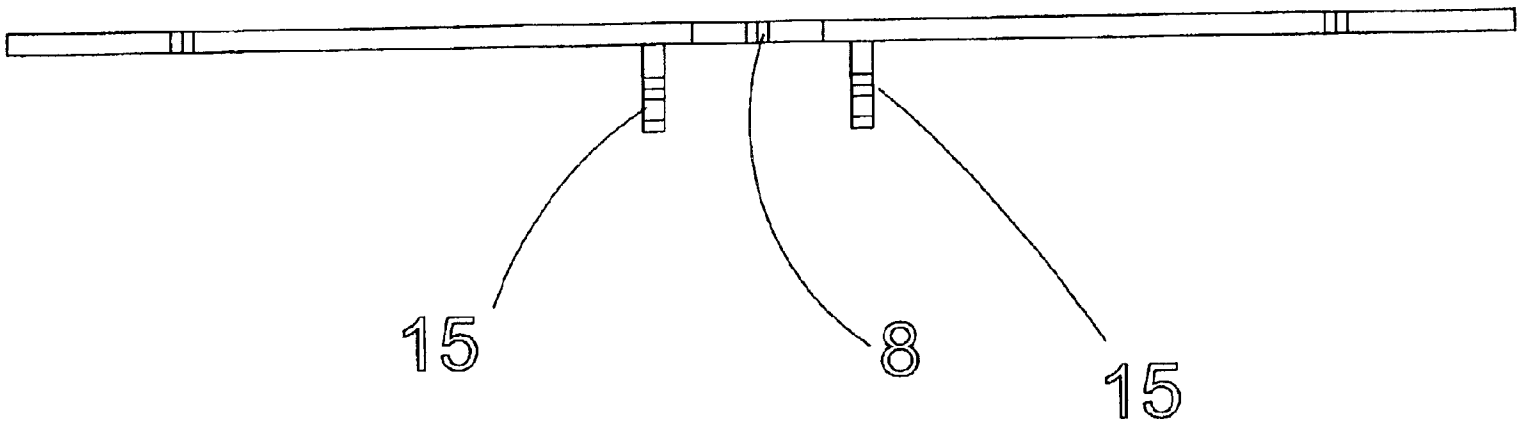
Figure 18:
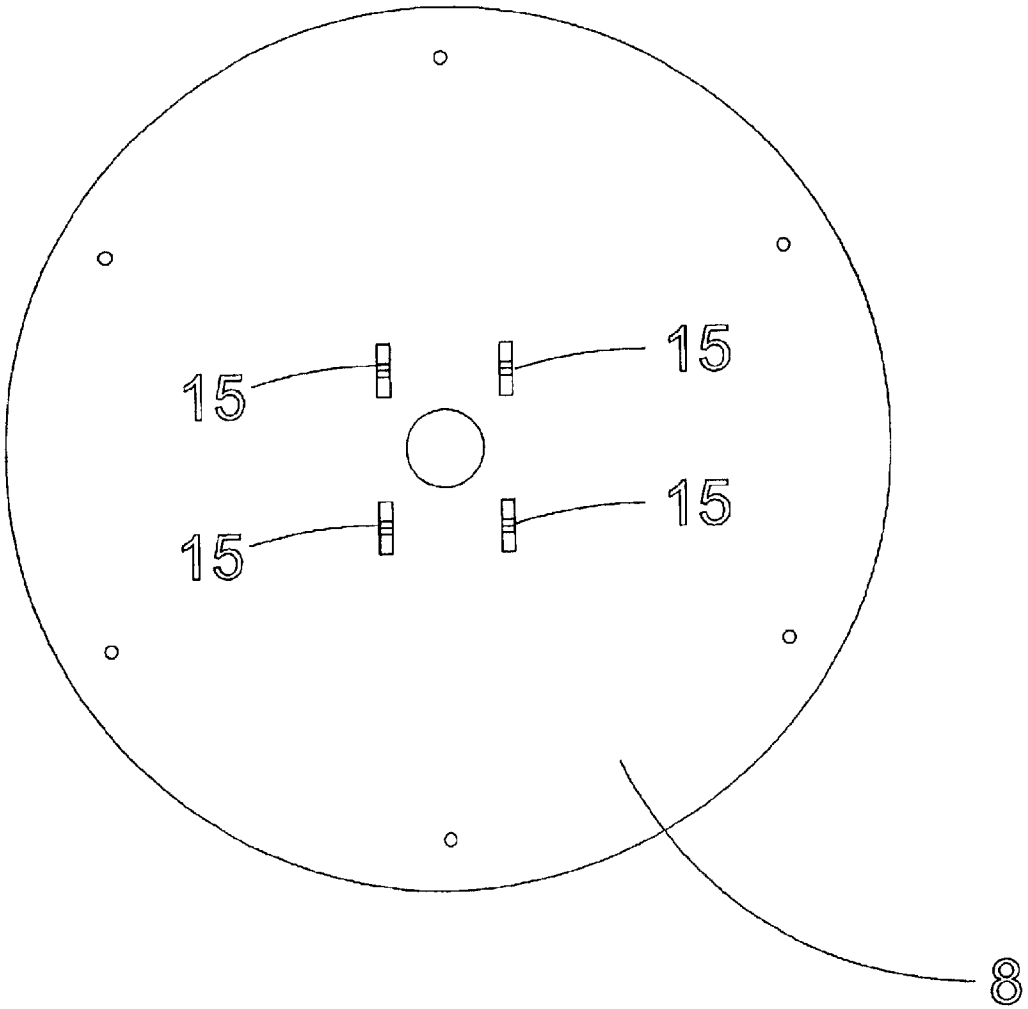
Figure 19:
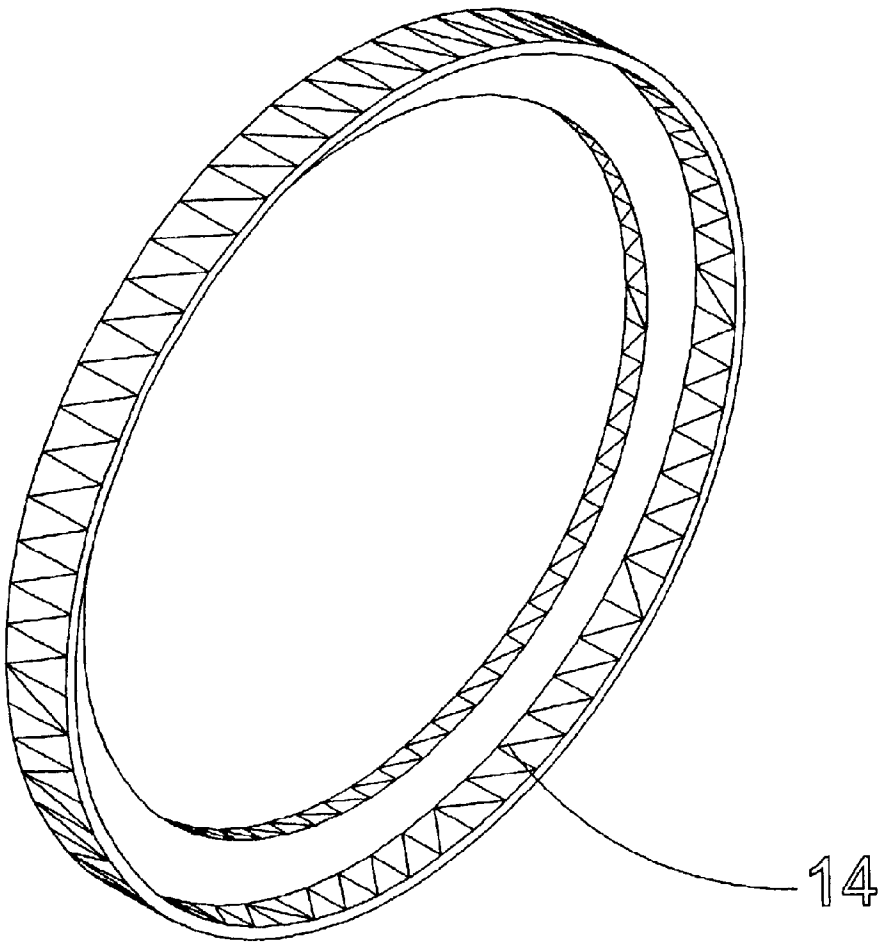
Figure 20:
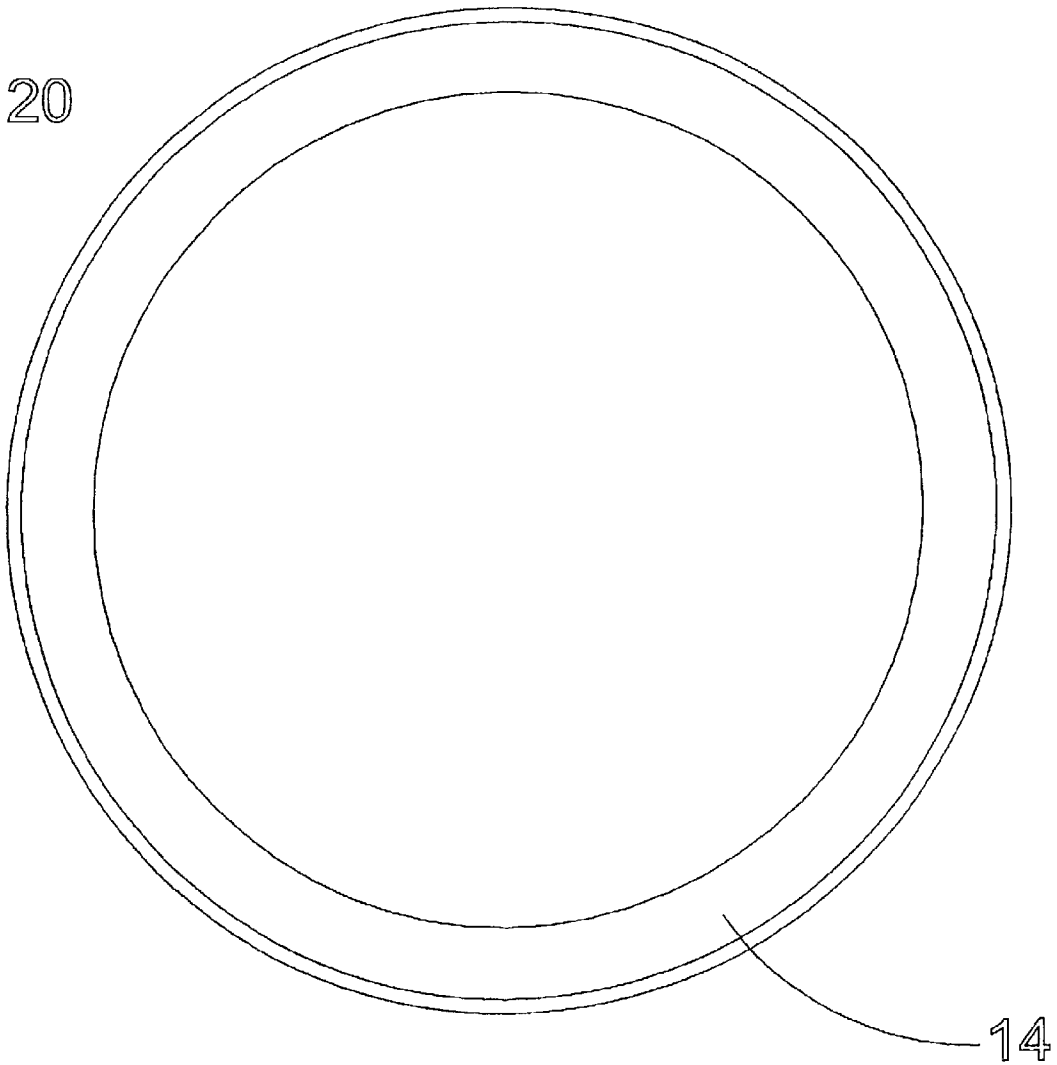
Figure 21:
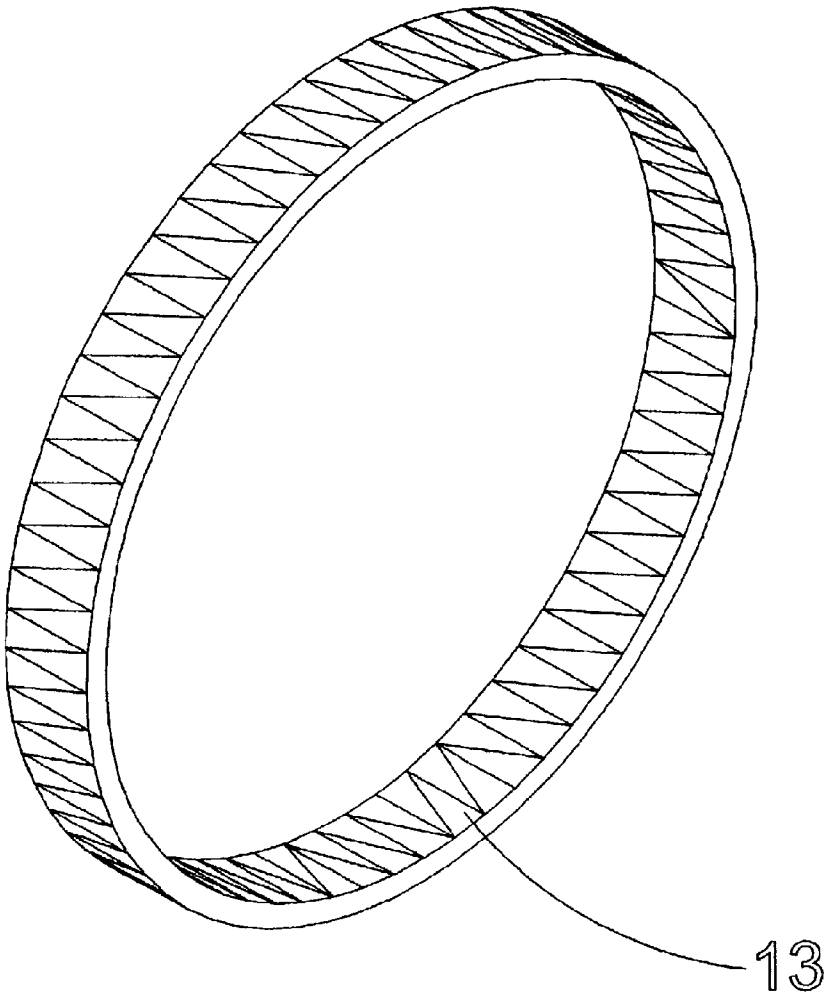
Figure 22:
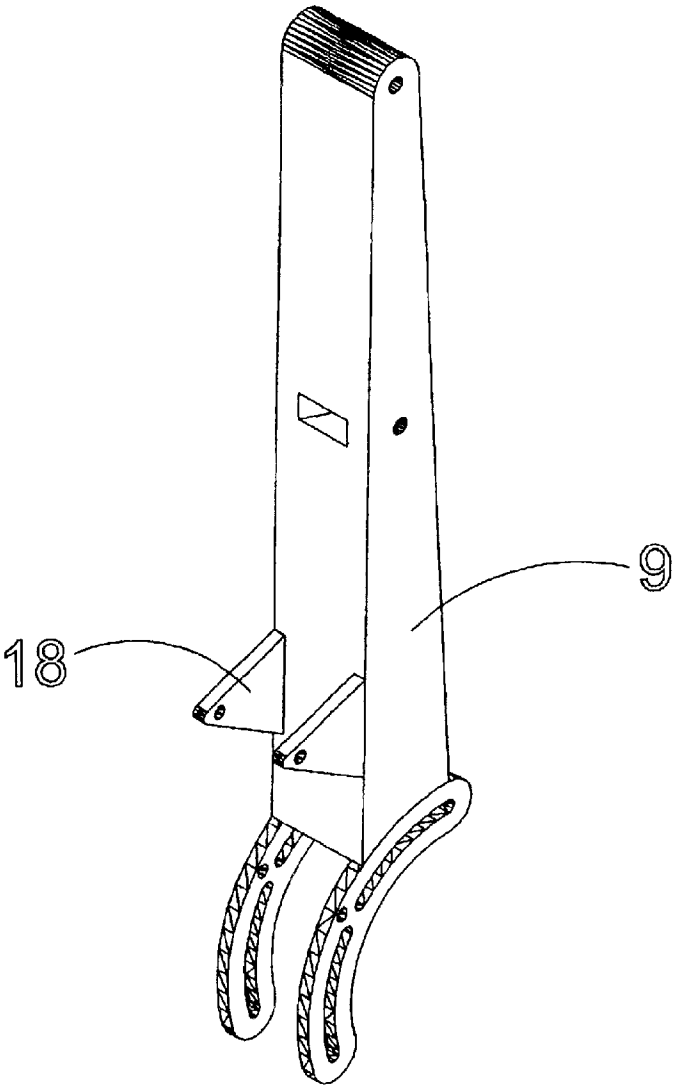
Figure 23:
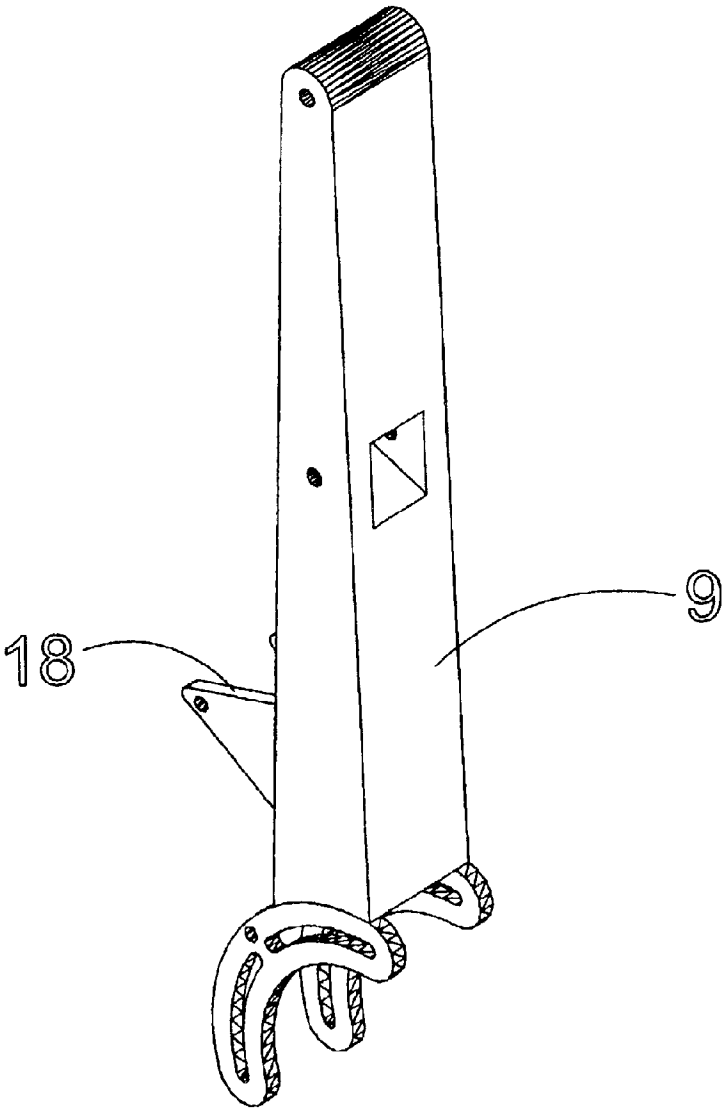
Figure 24:
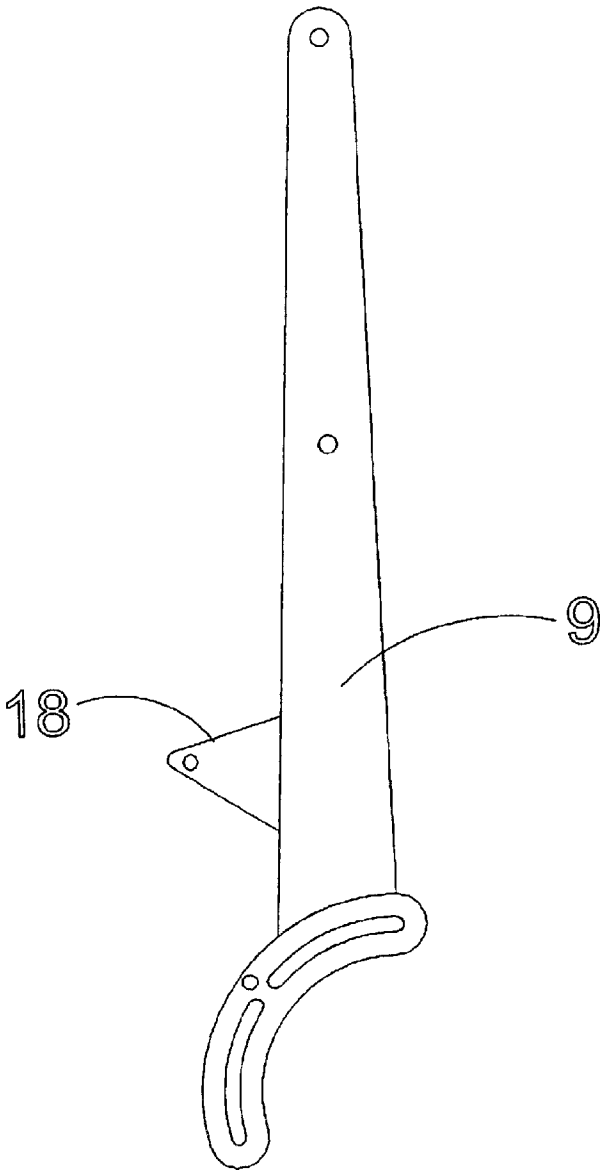
Figure 25:
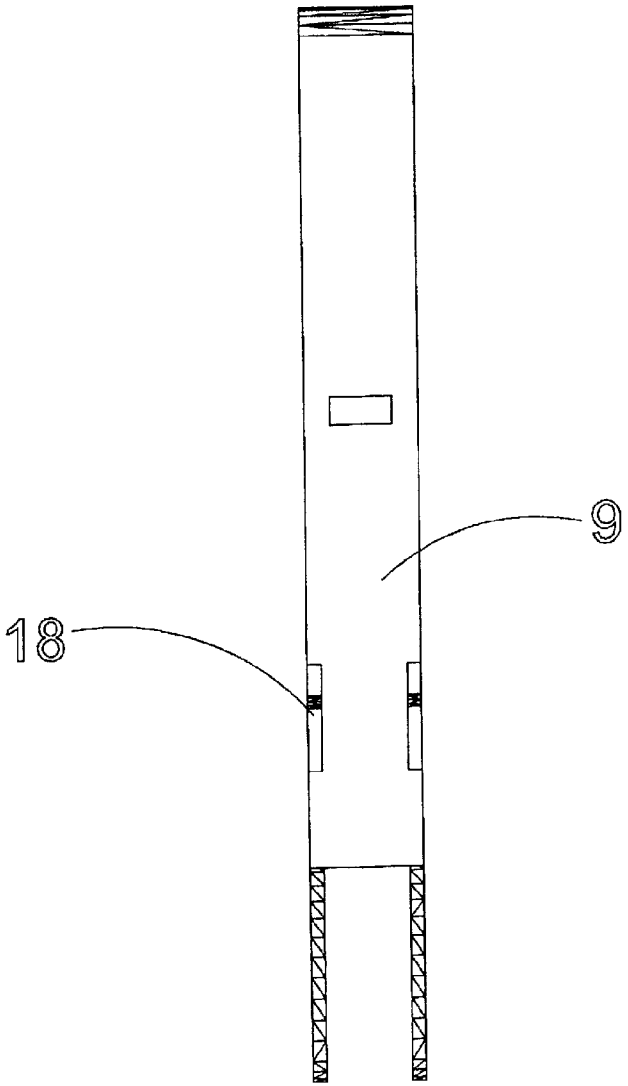

FIG. 6 is an isometric view of 10) the inner grasp palm and 11) the outer grasp palm FIG. 7 is an opposite hand view of FIG. 6 is an isometric view of 10) the inner grasp palm and 11) the outer grasp palm FIG. 8 is a side view of 10) the inner grasp palm and 11) the outer grasp palm FIG. 9 is an isometric view of the 17) mounting plate FIG. 10 is an isometric view of the 4) drive gear FIG. 11 is a front view of the 4) drive gear FIG. 12 is an isometric view of the 6) rotary gear FIG. 13 is a front view of the 6) rotary gear FIG. 14 is an isometric view of the 12) grip tooth FIG. 15 is an isometric view of the 8) mounting plate FIG. 16 is a side view of the 8) mounting plate FIG. 17 is a plan view of the 8) mounting plate FIG. 18 is a front view of the 8) mounting plate FIG. 19 is an isometric view of the 14) capture ring for rear bearing FIG. 20 is an front view of the 14) capture ring for rear bearing FIG. 21 is an isometric view of the 13) bearings for rotation FIG. 22 is an isometric view of the top of the 9) grasp boom showing the 18) padeyes FIG. 23 is an isometric view of the bottom of the 9) grasp boom showing the 18) padeyes FIG. 24 is a side view of the top of the 9) grasp boom showing the 18) padeyes FIG. 25 is a plan view of the top of the 9) grasp boom showing the 18) padeyes

DETAILED DESCRIPTION OF THE PREFERRED EMBODIMENTS

The APT 1 (Anode Placement Tool—Model 1) is a device to enable the more rapid installation of "Anode Bracelets" as they are called in the common language of the pipeline working world. Anodes are a part of the requirement of the cathodic protection system to protect pipelines. Whether that pipeline is buried under the ground or offshore under the water a need exists for the pipe to have a number of Anodes to give that pipeline cathodic protection. At present the anode is handled a number of times but there is no tool to place "Anode Bracelets" on the pipe in a manner that has the speed of installation that The APT 1 (Anode Placement Tool—Model 1) will make possible.

The APT 1 (Anode Placement Tool—Model 1) is intended to make the manual portion of installing an Anode upon the pipe a thing of the past.

The anodes are shipped to the pipe yard on a pallet where they are to be installed.

The 1) lift boom on The APT 1 (Anode Placement Tool—Model 1) lifts one half (½) of the Anode Bracelet (there are two (2) parts to make the entire anode cover the circumference of the pipe) from the pallet. This step is repeated twice so that the complete anode to be placed is in The APT 1 (Anode Placement Tool—Model 1).

The 1) lift boom then sets the one half (½) into the "palms"(10 inner grasp palm, 11) outer grasp palm) of The APT 1 (Anode Placement Tool—Model 1). When that one half (½) sets against the "palms", (10 inner grasp palm, 11) outer grasp palm) set in pairs (2 of each) then the 12) grip tooth secures that half of the anode on both sides of that anode half.

The step is repeated so that both halves of the Anode are set into The APT 1 (Anode Placement Tool—Model 1) so that the entire anode for that section is ready to be placed upon the pipe. The APT (Anode Placement Tool—Model 1) then rotates approximately ninety (90) degrees and the anode is ready to where it may be placed upon the pipe. The 9) grasp boom that hold the palms are open enough that the anode weld tabs do not touch the pipe. The Anode Bracelet is now ready to be placed in the proper position. The 9) grasp booms now close until the Anode is in contact with the pipe and if either portion of the Anode Bracelet needs a rotational adjustment axially upon the pipe then the hydraulic cylinder that is under or over that 9) grasp booms may be moved because the palms (10 inner grasp palm, 11) outer grasp palm)have a slide groove where to enable that portion of the work to be done hydraulically. The palms also (10 inner grasp palm, 11) outer grasp palm) have a hinge that is attached to a hydraulic cylinder that enables the palms to squeeze the anode so that anode half may better conform to the roundness aspect of the pipe upon where the Anode Bracelet is to be placed.

The Anode halves are each held in place by a 12) grip tooth on either side of the palms (10 inner grasp palm, 11) outer grasp palm) After the Anode halves have been set on and conformed to the circumference of the pipe surface. The welder may then proceed to weld those weld tabs on that Anode Bracelet. This will allow the pipe to move on to the next step of the process.

Numerous variations and modifications of the disclosed preferred and alternative embodiments will be apparent to skilled technicians. Without departing from the concept of the present invention, and all such variations and modifications are intended to be encompassed by the claims set forth herein.

| Parts list for APT | |
|---|---|
| 1. | Lift boom |
| 2. | Hydraulic motor |
| 3. | Gear reduction box |
| 4. | Drive gear |
| 5. | Pins |
| 6. | Rotary gear |
| 7. | Hydraulic cylinder |
| 8. | Mounting plate |
| 9. | Grasp boom |
| 10. | Inner grasp palm |
| 11. | Outer grasp palm |

-continued

| Parts list for APT | |
|---|---|
| 12. | Grip tooth |
| 13. | Bearings for rotation |
| 14. | Capture ring for rear bearing |
| 15. | Grasp boom padeyes |
| 16. | Capture bolts |
| 17. | Mounting plate |
| 18. | Padeyes for grasp boom |

The embodiments of the invention in which an exclusive property or privilege is claimed are defined as follows:

1. An apparatus for the installation of Anode Bracelets upon pipe for cathodic protection of pipe, said apparatus consisting of:

a) a pair of grasp booms equipped with the ability to grip a duality of Anode Bracelets, b) a means to rotate those grasp booms while holding that Anode Bracelet and hold open and then close at the appropriate time to close those Anode halves upon that pipe where that Anode Bracelet is to be installed, c) a means that can close that Anode Bracelet half so that it conforms close to that outside circumferential surface of the pipe where it is to be installed, d) a means that will allow a multiplicity of Anode Bracelets to be installed with the same tool upon multiple sections of pipe.

2. The apparatus of claim 1 further comprising of a set of palms with a grip tooth that grips each Anode Bracelet's half that will hold each half in place in the grasp palms until the time after the weld tabs are welded to make both halves an Anode Bracelet.

3. The apparatus of claim 1 further comprising of a set of rockers with palm and teeth that grips each Anode Bracelet's half that will hold each half in place in the palms and allow:

a) a movement of each half of the Anode Bracelet independently until a final position for welding is achieved b) a grip until the time after the weld tabs are welded c) a rotation of both halves of an Anode Bracelet that will maintain a grip upon the Anode Bracelets halves until the welding of said tabs is complete d) a release of that grip upon a complete Anode Bracelet after welding is completed so that the tool may be reused to place another Anode bracelet upon another pipe.

4. The apparatus of claim 1 further comprising of a tool that may be used upon various pipes and be used there upon a multiplicity of times to place Anode Bracelets.

* * * * *